US005437445A

United States Patent [19]

Chang et al.

[11] Patent Number: 5,437,445

[45] Date of Patent: Aug. 1, 1995

[54] METHOD AND APPARATUS FOR DETECTING DOUBLE FED SHEETS

[75] Inventors: Sung S. Chang, Stamford; Mark A. Gilbertie, Milford; Andrei Obrea, Wilton, all of Conn.

[73] Assignee: Pitney Bowes Inc., Stamford, Conn.

[21] Appl. No.: 970,671

[22] Filed: Oct. 8, 1992

[51] Int. Cl.[6] ..... B65H 7/12

[52] U.S. Cl. ..... 271/263; 33/1 B; 33/15 D

[58] Field of Search ..... 271/263, 258, 259, 265; 73/866; 33/1 B, 15 D

[56] References Cited

U.S. PATENT DOCUMENTS

| | | | |
|---|---|---|---|
| 4,741,526 | 5/1988 | Reed | 271/265 X |
| 4,761,002 | 8/1988 | Reed | 271/265 X |
| 4,879,513 | 11/1989 | Spiegel | 324/207 |
| 4,894,783 | 1/1990 | Milne | 271/263 X |
| 4,966,354 | 10/1990 | Grunder | 271/263 X |
| 4,982,947 | 1/1991 | Milne | 271/263 |
| 5,007,628 | 4/1991 | Skinner | 271/263 |
| 5,011,128 | 4/1991 | Tsuji | 271/263 |
| 5,087,135 | 2/1992 | Tew | 400/56 |
| 5,174,562 | 12/1992 | Mizunaga | 271/263 X |

FOREIGN PATENT DOCUMENTS

| | | | |
|---|---|---|---|
| 0289147 | 8/1988 | European Pat. Off. | G07D 1/00 |
| 2055766 | 7/1979 | United Kingdom | B65H 43/00 |

OTHER PUBLICATIONS

Power Hall-Hall Sensors, Machine Design/Aug. 23, 1990, Ravi Vig, Des. Eng. Manager, Sprague Semi Group, Concord, N.H.

European Search Report, Feb. 8, 1994.

Abstract/Zusammenfassung/Abrege; 93308028.5.

Patent Abstracts of Japan; vol. 11, No. 221 (M-608) (2668) 17 Jul. 1987.

Patent Abstracts of Japan; vol. 10, No. 114 (M-473) (2171) 26 Apr. 1986.

Patent Abstracts of Japan; vol. 13, No. 373 (M-861) (3721) 18 Aug. 1989.

*Primary Examiner*—H. Grant Skaggs

*Attorney, Agent, or Firm*—Robert H. Whisker; Melvin J. Scolnick

[57] ABSTRACT

A method and apparatus for detecting double fed sheets. A sheet passes beneath a roller which is mounted on a lever so that the opposite end of the lever is deflected by an amount proportional to the thickness of the sheet. A magnet is attached to the opposite end of the lever approximate to a Hall Effect sensor fixed to the frame of the apparatus so that the hall sensor produces a signal proportional to the thickness of the sheet. The output of the hall sensor is sampled by an A/D convertor and the signals are input to a computer for processing to detect double fed sheets. Average thicknesses for subsequences of samples distributed over the sheet are computed and compared to reference levels. The length of the sheet is also compared to a reference length. If, for any of these comparisons the measured values are greater than the references a doubled detect signal is generated. In one embodiment leading and trailing edges of the sheet may be detected by detecting transitions in the sequence of signals which are greater than the design minimum sheet thickness. In another embodiment of the subject invention the reference levels are established by first measuring a selected, assured single, initial sheet. In another embodiment of the subject invention the references are updated after each sheet by combining a portion of the previous reference value, preferably $\frac{7}{8}$th's, with a portion, preferably $\frac{1}{8}$th, of the measure value multiplied by an appropriate scale factor.

35 Claims, 5 Drawing Sheets

METHOD AND APPARATUS FOR DETECTING DOUBLE FED SHEETS

BACKGROUND OF THE INVENTION

The subject invention relates to feeding of single sheets of paper or the like from a stack of sheets for processing by folders, printers, copiers or the like. More particularly, it relates to detecting double fed sheets which occur when a sheet feeder fails to properly singulate sheets from the stack.

In printers, copiers, inserters, and similar such systems it is frequently necessary to singulate sheets from a stack of sheets for further processing by the system. Many mechanisms have been developed to perform this singulation function, and, in general, they are effective. However, inevitably such sheet feeders will fail and feed a "double" (i.e. two or more overlapping sheets). Such double fed sheets may jam in the system, requiring operator intervention to clear the jam. Perhaps more importantly, if the sheets contain information or are otherwise unique (e.g. return of cancelled checks) then their destruction in a jam caused by a double feed may significantly interfere with operations.

For these reasons it is known to provide such systems with detectors down stream from the sheet feeder to detect double fed sheets before a jam and possible destruction of the sheets can occur. One known method is to use an optical system to measure the transparency of a sheet after it is fed from the sheet feeder. Another known method uses precise, sensitive mechanical switches to detect an increase in the thickness of a fed sheet. Both of these methods for detecting double fed sheets involve precise, pains staking adjustments each time the type of sheet to be fed is changed.

Accordingly, it is an object of the subject invention to provide a method and apparatus for detecting double fed sheets which is easily adaptable to different types of sheets to be fed.

BRIEF SUMMARY OF THE INVENTION

The above objects are achieved and the disadvantages of the prior art are overcome in accordance with the subject invention by means of a method and apparatus for detecting double fed sheets which includes a first mechanism responsive to the passage of a sheet fed from a feeder to generate a sequence of signals representative of the thickness of the sheet at a corresponding sequence of positions on the sheet. In accordance with the subject invention the signals are processed to determine an average thickness for at least a subsequence of the positions and the average thickness is compared to a predetermined reference value. If the average thickness is greater than the reference value a double detect signal representative of a double fed sheet is generated.

In accordance with one aspect of the subject invention the apparatus includes a mechanism for detecting the leading and trailing edges of the sheet and responds to the leading and trailing edges to determine the length of the sheet, and generates the double detect signal if the measured length is greater than a predetermined reference length.

In accordance with another aspect of the subject invention the first mechanism outputs a series of signals which includes the sequence of signals and idle level signals representing an idle level corresponding to an absence of sheets and the apparatus responds to a positive transition in the series of signals from the idle level to detect the leading edge, if the positive transition is greater than a minimum design thickness for the sheets, and responds to a negative transition in the series of signals to detect the trailing edge if the negative transition is greater than the minimum design thickness, and returns to the idle level.

In accordance with still another aspect of the subject invention the reference value and reference length are determined as functions of the thickness and length of a selected, initial, single sheet. In accordance with yet another aspect of the subject invention the reference level and reference length are updated with new reference levels and reference length after the passage of each sheet; the new reference levels and reference lengths being functions of the thickness and length of each sheet.

Thus it can be seen that the subject invention achieves the above objects and advantageously overcomes the difficulties of the prior art. Other objects and advantages of the subject invention will be apparent to those skilled in the art from the detailed description set forth below.

BRIEF DESCRIPTION OF PREFERRED EMBODIMENTS OF THE SUBJECT INVENTION

Figure 1:
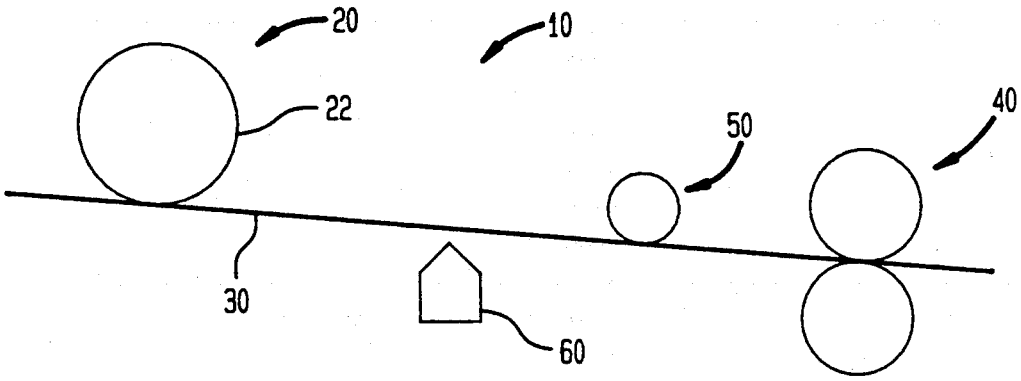
FIG. 1 shows a schematic representation of a generalized paper handling system including a mechanism for detecting double fed sheets in accordance with the subject invention.

FIG. 1 shows a schematic representation of a paper handling system 10. System 10 includes a sheet feeder 20 which has a singulating roller 22 for separating single sheets from a stack of sheets (not shown) and feeding these sheets along a feed path 30 to take away rollers 40 for further processing. And apparatus 50 in accordance with the subject invention is provided down stream from Sheet feeder 20, and prior to take away rollers 40 to detect double fed sheets. In accordance with one embodiment of the subject invention a photodetector 60 may be provided to detect leading and trailing edges of the sheets. This embodiment may be preferred if photo detectors are necessary for other purposes, such as providing timing signals. In another embodiment apparatus 50 may detect the leading and trailing edges of the sheet, as will be described below.

Figure 2:
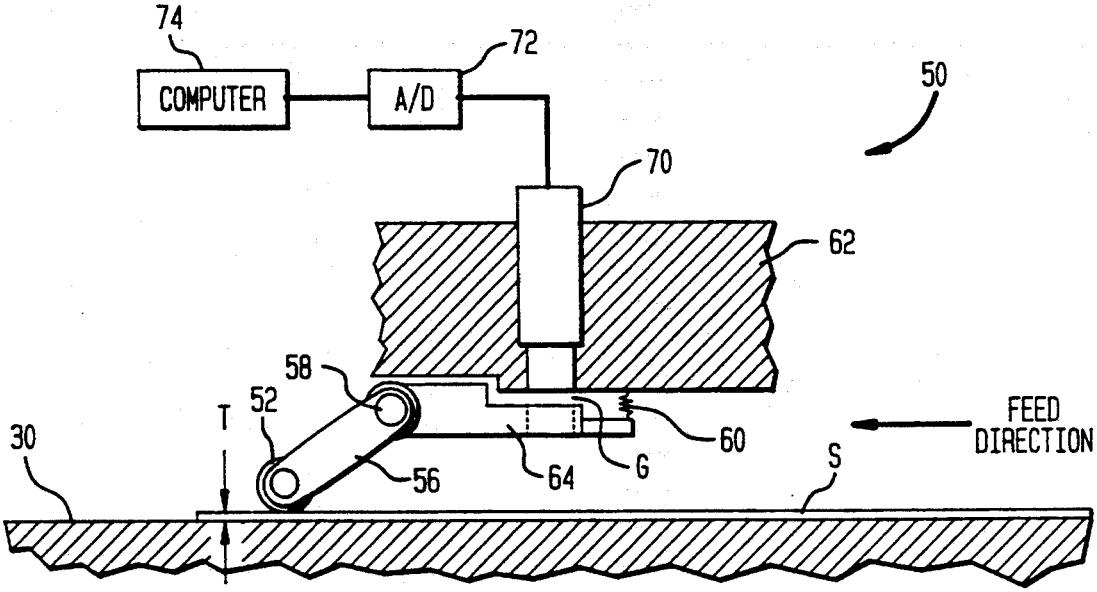
FIG. 2 shows a semi-schematic representation of the mechanism of the subject invention.

FIG. 2 shows a semi-schematic representation of apparatus 50. Sheet S is fed along path 30 by sheet feeder 20 and passes beneath roller 52. Roller 52 is mounted on lever arm 56 which rotates about pivot 58. Spring 60 is mounted in tension between lever arm 56 and frame 62 to provide a restoring force to maintain roller 52 in positive engagement with sheet S.

As sheet S passes beneath roller 52 gap G will change by an amount proportional to thickness T of sheet S at the position beneath roller 52.

In a preferred embodiment of the subject invention a permanent magnet 64 is fixed to lever 56 in proximity to Hall Effect detector 70 which is fixed within frame 62. Thus, detector 70 produces an analog output proportional to thickness T of sheet S at the position beneath roller 52. The analog output is sampled by A/D convertor 72 to generate digital inputs signals which are input to computer 74. The input signals are processed by computer 74 to generate a double detect signal if a double fed sheet passes beneath roller 52, as will be described below.

Preferably detector 70 is a model 92SS12-2 analog positions sensor marketed by the MicroSwitch division of Honeywell Corporation, or equivalent. However, other forms of sensors, such as inductive sensors, strain gauges, etc. are within the contemplation of the subject invention.

Those skilled in the art will recognize that the particular details of the mechanical design to detect thickness T of sheet S will vary almost without limitation depending upon the particular application. Such design would be well within the ability of those skilled in the art and details of the particular mechanical design selected form no part of the subject invention.

Figure 3:
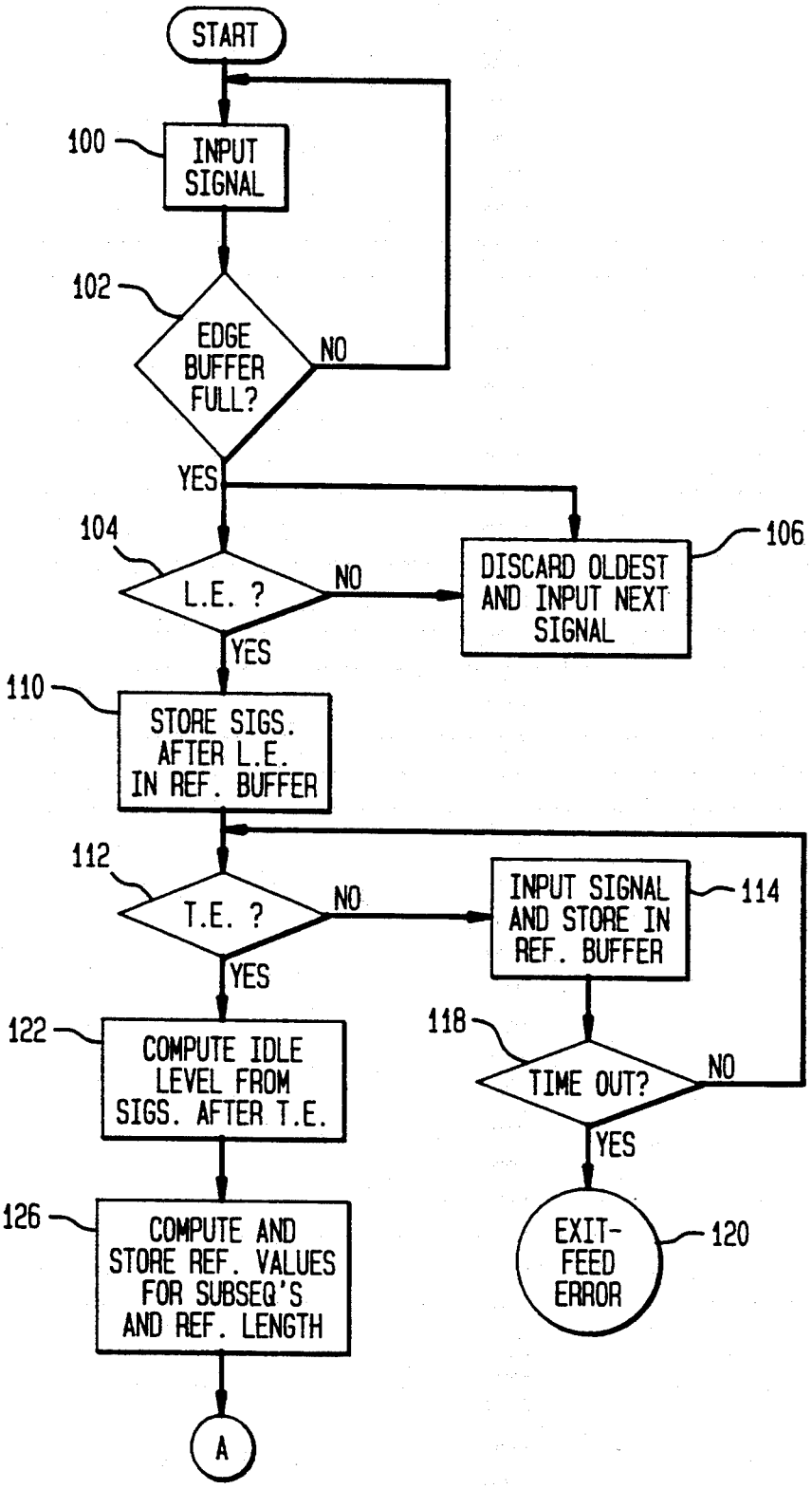
FIG. 3 shows a flow chart of the operation of the apparatus of the subject invention in determining the initial idle level and reference values and reference length from measurements on a selected, initial, single sheet.

FIG. 3 shows a flow chart of the operation of computer 74 in computing reference values and reference lengths and the value for an idle level representative of the absence of any sheets.

Prior to computing the references an initial, assured single sheet is selected and input.

At 100 computer 74 inputs a signal representative of thickness T. Since initially the selected sheet will not have reached roller 52 the initial signals will be at the idle level. At 102 the program 74 tests to determine if sufficient signals have been stored in an edge buffer so that the series of signals may be tested for the presence of a leading edge of sheet S. If the edge buffer is not full then computer 74 returns to 100 to input another Signal. When the edge buffer is full then at 104 the program 74 tests the contents of the edge buffer to determine if a leading edge is present. If no leading edge is found then at 106 the oldest signal is discarded and the next signal is input and computer 74 returns to 104 to again test for the leading edge.

When the leading edge is found, then at 110 signals occurring after the leading edge are stored in a reference buffer, and at 112 computer 74 tests for the trailing edge. If no trailing edge is found at 112, then at 114 computer 74 inputs the next signal and stores it in the reference buffer. Then at 118 the program 74 tests to determine if a timeout has occurred. If so, then at 120 computer 74 exits to a feed error routine.

If no timeout has occurred at 118, computer 74 returns to 112 and tests again for the trailing edge.

When the trailing edge is found, then at 122, the program 74 computes initial values for the idle level from signals input after the trailing edge. And at 126 the program 74 computes and stores reference values for average thicknesses for sheet S and a reference length for sheet S.

To compute the reference values the sequence of signals between the leading edge and trailing edge which were stored in the reference buffer are divided into a number, preferably about 10, of equal subsequences and average thickness values for each subsequence are computed. These average thicknesses are then multiplied by a factor, preferable approximately 1.25, to determine the reference values. The reference length is determined by the number of samples multiplied by a factor, preferably 1.50, to determine the reference length.

Details of the manner in which computer 74 detects the leading edge and trailing edge of sheet S will be described further below with respect to FIGS. 6 and 7.

Figure 4:
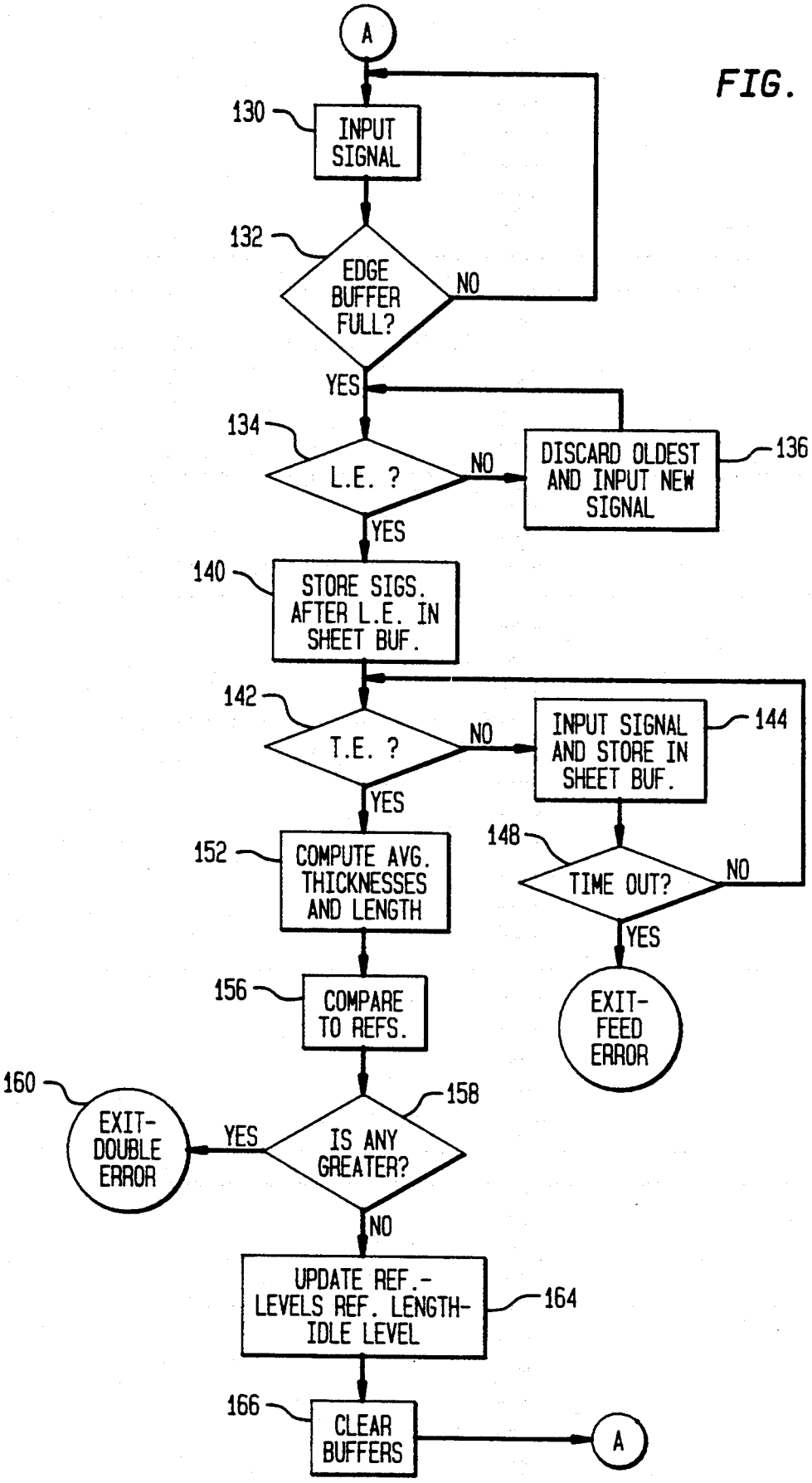
FIG. 4 shows a flowchart of the operation of the apparatus of the subject invention in detecting double fed sheets.

FIG. 4 shows a flow chart of the operation of computer 74 in detecting double fed sheets in accordance with the subject invention. At 130 computer 74 inputs signals, and at 132 tests to determine if the edge buffer is full. If not, the program returns to 130 to input the next signal.

When the edge buffer is full, then, at 134 the program test to determine if a leading edge has been found. If not, at 136, the oldest signal is discarded and the next is input. When the leading edge is found, then, at 140 signals occurring after the leading edge are stored in a sheet buffer, and, at 142 the program tests for the trailing edge. If no trailing edge is found then, at 144 the program inputs the next signal and stores it in the sheet buffer, and then, at 148, tests for a timeout. If a timeout occurs then, at 150, the program exits to a feed error routine. If no timeout occurs, then the program returns to 142 and again tests for the trailing edge of sheet S.

When the trailing edge is found then, at 152 the program computes average thicknesses for subsequences of signals between the leading edge and trailing edge corresponding to the subsequences for which reference values were computed at 126; and also computes the length of sheet S. Then, at 156 the program tests to determine if any of the average thicknesses are greater than the corresponding reference value or if the length is greater than the reference length. If, in any comparison, the value for sheet S is greater than the corresponding reference the program exits to a double error routine at 160.

Preferably, then at 164 in order to compensate for long term variations, such as drift, the references are updated by combining the average thicknesses and length determined for sheet S with the present reference values and reference length. Preferably, this is achieved by first multiplying the average thicknesses and the length for sheet S by the appropriate factors (i.e. approximately 1.25 and 1.50) and then adding $\frac{1}{8}$th of the values so determined to $\frac{7}{8}$th's of the values for the corresponding previous references. Also at 164 the value for the idle level is updated in a similar fashion using signal values measured after the trailing edge is detected.

Then at 166, the program clears all buffers and returns to input signals to test the next sheet for a double feed error.

The programs described in FIGS. 3 and FIG. 4 have been described separately for ease of explanation, and those skilled in the art will recognize that many of the functions are the same, and preferably would be implemented by common subroutines.

Figure 5:
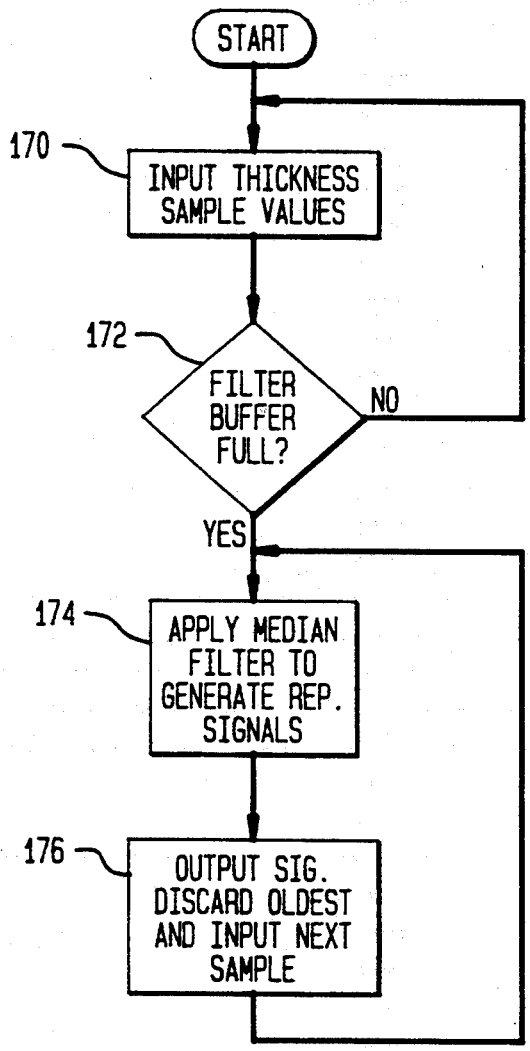
FIG. 5 shows a flow chart of a filter which may be applied to measured sample values to eliminate noise in one embodiment of the subject invention.

FIG. 5 shows a flow chart of the operation of computer 74 in implementing an optional median filter, which is effective to eliminate noise Which might otherwise be mistaken for a leading or trailing edge of the sheet.

At 170 digital thickness samples from A/D converter 72 are input and at 172 the program tests to determine if the filter buffer is full. If not, the program returns to 170 to input the next sample.

When the filter buffer is full, then at 174 the program applies a median filter to generate representative signals for input to the routines of FIGS. 3 and 4.

The filter buffer stores a predetermined, odd number of samples, preferably 5, and to apply to median filter arranges these samples in strictly non-descending or non-ascending order, and then selects the median (i.e. middle) sample. The selected sample is output as the representatives signal and then, at 176 the oldest sample in the filter buffer is discarded and the next sample is input and the program returns to 174 to generate the next representative signal.

It should be noted that it is preferred to compare average thicknesses for subsequences of samples of a sheet with corresponding reference levels to provide for applications where folded sheets (e.g. envelopes) are fed. Such sheets have varying thickness profiles which might trigger a false doubled detect signal if only a single average were computed.

In a preferred embodiment of the subject invention samples of thickness T are taken approximately every 35 microseconds.

Figure 6:
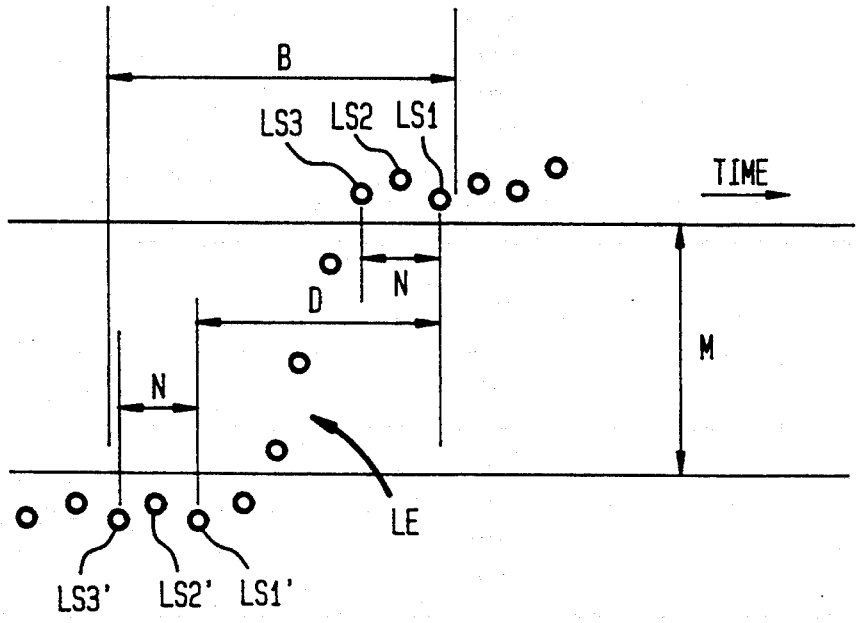
FIG. 6 is a graphic representation of the detection of the leading edge of a sheet.

FIG. 6 shows a graphic representation of the operation of the program at 104 and 134 in detecting the leading edge of sheet S. As described, the edge buffer contains a rolling sequence of the B moist recent samples input to the program. To detect a leading edge the N most recent samples are compared with the N Oldest samples in the buffer. In FIG. 6 LS 1 is compared with LS 1′, LS2 is compared with LS2′ and LS3 is compared with LS3′. That is, each of the N most recent samples is compared with the sample which occurred D samples earlier. If for each comparison the difference between the samples exceeds M, where M is a design minimum thickness for a sheet S then a leading edge is presumed to be found.

Figure 7:
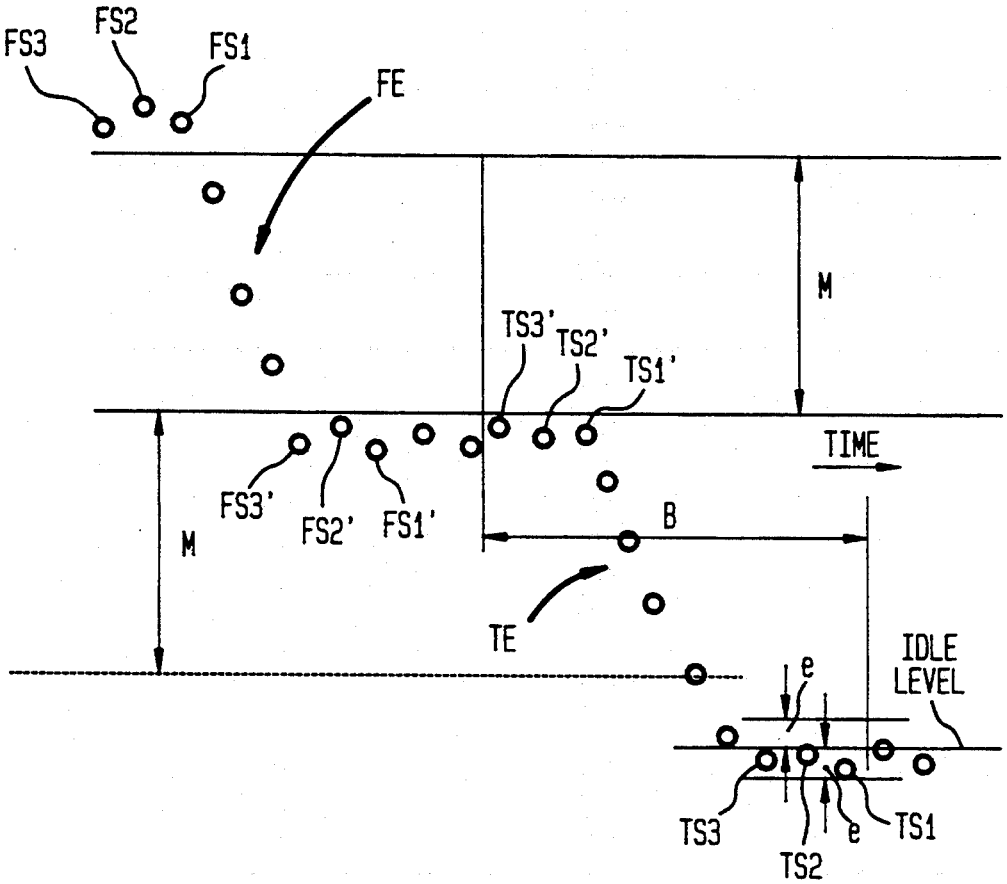
FIG. 7 is a graphic representation of the detection of a trailing edge of a sheet.

FIG. 7 shows the operation of the program at 112 and 144 in detecting the trailing edge of sheet S. Rather than storing a rolling sequence of samples the program at the B most recent samples in the reference or the sheet buffer to detect the trailing edge TE. As with the leading edge, again the N most recent samples are compared with corresponding samples which occurred D sample intervals earlier. That is, sample TS1 is compared sample TS1′ etc. Again, if for each comparison the difference is greater than the design minimum M the program tentatively identifies a trailing edge TE. However, to distinguish trailing TE from a false trailing edge FE, which may be caused by roller 52 bouncing due to vibration, an additional test is applied to determine if signals TS1, TS2, and TS3 are within a predetermined distance e of the Idle Level. If this is so the program assumes that roller 52 has not bounced sheet S and that trailing edge TE has been found.

In a preferred embodiment N=3 and D=15.

(Those skilled in art will recognize that false leading edges caused by a bounce of roller 52 are not of concern since the immediate return to the idle level would correspond to an impossibly short sheet.)

The above preferred embodiments have been described by way of illustration and example only, and numerous other embodiments of the subject invention will be apparent to those skilled in the art from consideration of the above description. Accordingly limitations on the subject invention are to found only in the claims set forth below.

What is claimed is:

1. A mechanism for detecting doubled sheets fed from a feeder, comprising:

a) first means, responsive to the passage of a sheet fed from said feeder, for generating a sequence of signals representative of the thickness of said sheet at a corresponding sequence of positions on said sheet;

b) second means, responsive to'said sequence of signals for:

b1) determining an average thickness for at least a subsequence of said positions;

b2) comparing said average thickness to a predetermined reference value; and b3) if said average thickness is greater than said reference value generating a double detect signal representative of a double fed sheet.

2. A mechanism as described in claim 1 further comprising:

a) third means for detecting leading and trailing edges of said sheet as said sheet is fed from said sheet feeder;

b) fourth means, responsive to detection of said leading and trailing edges, for determining if the length of said sheet is greater than a predetermined reference length; wherein c) said second means is responsive to said fourth means to generate said double detect signal if the length of said sheet is greater than said reference length.

3. A mechanism as described in claim 2 wherein said first means outputs a series of signals comprising said sequence of signals and idle level signals representative of an idle level corresponding to an absence of sheets, and said third means is responsive to a positive transition in said series of signals from said idle level to detect said leading edge and to a later negative transition in said series of signals to detect said trailing edge.

4. A mechanism as described in claim 3 wherein said third means is responsive to said positive transition only if said positive transition is greater than a minimum value corresponding to a design minimum thickness of said sheet.

5. A mechanism as described in claim 4 wherein said third means is responsive to said positive transition only if said positive transition is greater than a minimum value, corresponding to a design minimum thickness of said sheet.

6. A mechanism as described in claim 3 wherein said third means is responsive to said negative transition only if said negative transition is greater than a minimum value corresponding to a design minimum thickness, and said negative transition returns to within a predetermined distance of said idle level.

7. A mechanism as described in claim 6 wherein, after detection of said trailing edge said idle level is updated with a new idle level, said new idle level being a function of said idle level and values of said idle level signals after detection of said trailing edge.

8. A mechanism as described in claim 3 wherein said first means further comprises:

a1) sampling means for sampling the thickness of said sheet of said sequence of positions to generate input signals;

a2) filter means for filtering said input signals to generate said series of signals.

9. A mechanism as described in claim 8 wherein said filter means comprises a median filter.

10. A mechanism as described in claim 9 wherein said third means is responsive to said positive transition only if said positive transition is greater than a minimum value corresponding to a design minimum thickness of said sheet.

11. A mechanism as described in claim 8 wherein said third means is responsive to said negative transition only if said negative transition is greater than a minimum value corresponding to a design minimum thickness, and said negative transition returns to within a predetermined distance of said idle level.

12. A mechanism as described in claim 2 wherein said third means comprises a photodetector.

13. A mechanism as described in claim 2 further comprising reference determining means for determining said predetermined reference values as a function of the thickness of a selected, initial, single sheet at second positions, said second positions corresponding to said subsequence of said positions.

14. A mechanism as described in claim 2 further comprising second reference determining means for determining said reference length as a function of the length of a selected, initial, single sheet.

15. A mechanism as described in claim 14 wherein, after passage of said sheet said reference length is updated with a new reference length, said new reference length being a function o said reference length and the length of said sheet.

16. A mechanism as described in claim 1 wherein said second means:

a1) determines average thicknesses for a plurality of subsequences of said positions;

a2) compares said average thicknesses to corresponding predetermined reference values; and a3) if any one of said average thicknesses is greater than its corresponding reference value, generates said double detect signal.

17. A mechanism as described in claim 16 further comprising reference determining means for determining said predetermined reference values as a function of the thickness of a selected, initial, single sheet at second positions, said second positions corresponding to said subsequences of said positions.

18. A mechanism as described in claim 17 wherein, after passage of said sheet said reference values are updated with new reference values, said new reference values being a function of said reference values and the thickness of said sheet at said subsequences of positions.

19. A mechanism as described in claim 18 wherein, after passage of said sheet said reference values are updated with new reference values, said new reference values being a function of said reference values and the thickness of said sheet at said subsequence of positions.

20. A mechanism as described in claim 1 further comprising reference determining means for determining said predetermined reference as a function of the thickness of a selected, initial, ingle sheet at second positions, said second positions corresponding to said subsequence of said positions.

21. A mechanism as described in claims 20 wherein, after passage said sheet said reference values are updated with new reference values, said new reference value being a function of said reference values and the thickness of said sheet at said subsequence of positions.

22. A method for detecting double sheets fed from a feeder, comprising the steps:

a) generating a sequence of signals representative of the thickness of a sheet fed from said feeder at a corresponding sequence of positions on said sheet;

b) processing said signals to determine an average thickness for at least a subsequence of said positions;

c) comparing said average thickness to a predetermined reference value; and, d) if said average thickness is greater than said reference value generating a double detect signal representative of a double fed sheet.

23. A method as described in claim 22 comprising the further step of:

a) detecting leading and trailing edges of said sheet as said sheet as fed from said feeder;

b) responding to detection of said leading and trailing edges to determine if the length of said sheet is greater than a predetermined length, and c) generating said double detect signal if the length of said sheet is greater than said reference length.

24. A method as described in claim 23 comprising the further steps of:

a) generating a series of signals comprising said sequence of signals and idle level signals representative of an idle level corresponding to an absence of sheets;

b) responding to a position transition in said series of signals from said idle level to detect said leading edge; and, c) responding to a later negative transition in said series of signals to detect said trailing edge.

25. A method as described in claim 24 wherein said positive transition must be .greater than a minimum value corresponding to a design minimum thickness of said sheet.

26. A method as described in claim 24 wherein said negative transition must be greater than a minimum value corresponding to a design minimum thickness of said sheet, and said negative transition must return to within a predetermined distance of said idle level.

27. A method as described in claim 26 wherein after detection of said trailing edge said idle level is updated with a new idle level, said new idle level being a function of said idle level and values of said idle level signals after detection of said trailing edge.

28. A method as described in claim 24 comprising the further steps of:

a) sampling the thickness of said sheet at said sequence of positions to generate input signals; and b) filtering said input signals to generate said series of signals.

29. A method as described in claim 28 wherein said input signals are filtered by a median filter.

30. A method as described in claim 23 wherein said predetermined reference values are determined as a function of the thickness of a selected, initial, single sheet at second positions, said second positions corresponding to said subsequence of positions.

31. a method as described in claim 30 further comprising the step of, after completion of processing of said sheet, updating said reference values with new reference values, said new reference values being a function of said reference values and the thickness of said sheet at said subsequence of positions.

32. A method as described in claim 23 wherein said predetermined reference length is determined as a function of the length of a selected, initial, single sheet.

33. A mechanism as described in claim 32 further comprising the step of, after completion of processing of said sheet, updating said reference length with a new reference length, said new reference length being a function of said reference length and the length of said sheet.

34. A method as described in claim 22 wherein said predetermined reference values are determined as a function of the thickness of a selected, initial, single sheet at second positions, said second positions corresponding to said subsequence of positions.

35. A method as described in claim 34 further comprising the step of, after completion of processing of said sheet, updating said reference values with new reference values, said new reference values being a function of said reference values and the thickness of said sheet at said subsequence of positions.

* * * * *